US007032615B2

(12) United States Patent
Trueb et al.

(10) Patent No.: US 7,032,615 B2
(45) Date of Patent: Apr. 25, 2006

(54) PIPE-COVERING MEMBER HAVING TEAR-AWAY PORTIONS

(75) Inventors: Thomas W. Trueb, Ellington, CT (US); Steven R. Trueb, Ellington, CT (US)

(73) Assignee: Watertite Products, Inc., Collierville, TN (US)

( * ) Notice: Subject to any disclaimer, the term of this patent is extended or adjusted under 35 U.S.C. 154(b) by 461 days.

(21) Appl. No.: 10/407,880

(22) Filed: Apr. 4, 2003

(65) Prior Publication Data

US 2004/0194826 A1 Oct. 7, 2004

(51) Int. Cl.
*F16L 7/00* (2006.01)

(52) U.S. Cl. ..... 137/375; 137/797; 138/155; 138/159; 285/47

(58) Field of Classification Search ..... 137/797, 137/375; 138/155, 159; 285/47
See application file for complete search history.

(56) References Cited

U.S. PATENT DOCUMENTS

| | | | | |
|---|---|---|---|---|
| 2,449,265 | A * | 9/1948 | Williams | 138/118 |
| 5,054,513 | A | 10/1991 | Trueb et al. | |
| 5,303,730 | A | 4/1994 | Trueb et al. | |
| 5,360,031 | A | 11/1994 | Trueb et al. | |
| 5,699,828 | A | 12/1997 | Helmsderfer | |
| 5,701,929 | A | 12/1997 | Helmsderfer | |
| 5,960,820 | A * | 10/1999 | Helmsderfer | 137/375 |

* cited by examiner

*Primary Examiner*—A. Michael Chambers
(74) *Attorney, Agent, or Firm*—Alston & Bird LLP

(57) ABSTRACT

The inside surfaces of pieces constituting an undersink pipe-covering system are formed with series of weakness zones, at spaced intervals and with associated distance scale indicia, to permit facile and convenient length determination and manual severance for adjustment, while affording aesthetic appeal.

16 Claims, 2 Drawing Sheets

PIPE-COVERING MEMBER HAVING TEAR-AWAY PORTIONS

BACKGROUND OF THE INVENTION

As a result of regulatory mandate and good policy, the piping under sinks in public places is (at least in the United States) now routinely insulated to provide protection, particularly for wheelchair-bound individuals, against burns, scalding, abrasions, and other injury. While the patent art discloses numerous forms of protective covers for that purpose, particularly desirable systems are provided by Steven R. Trueb and Thomas W. Trueb (see for example U.S. Pat. Nos. 5,054,513, 5,303,730 and 5,360,031) and by John A. Helmsderfer (see for example U.S. Pat. Nos. 5,699,828 and 5,701,929), which patents are of common assignment herewith.

It is appreciated that two criteria (apart from essential protective functions) are particularly important in the provision of optimal pipe insulation of this kind: The components should be aesthetically attractive, with a smooth, graceful appearance, free from extraneous discontinuities and unduly exposed utilitarian mechanical features; and the design should be such that the time required for installation is minimized, as by facilitating or eliminating the need for measuring, marking, and cutting of the insulation pieces to achieve a proper fit on existing piping (the sections normally being made to excessive lengths, with that intent).

The above-mentioned U.S. Pat. No. 5,701,929 seeks to achieve the latter objective by incorporating structurally weakened areas (i.e., blind "perforations" or circumferential thin-wall areas) into a unitary body, which areas are located to permit manual separation for forming first and second cover pieces and to enable manual trimming of end portions during installation. In all instances the structurally weakened areas disclosed in the '929 patent appear to be comprised of elements extending inwardly from the exterior surface of the body. So too, U.S. Pat. No. 5,054,513 shows series of grooves formed into the outer surfaces of the tail piece and waste arm cover members, which grooves serve not only to receive fastening bands but also to designate locations for cutting. It is noted that the '730 and '031 patents describe a valve-insulating piece having a cover component that is secured to the main body by nips, or weak connecting elements, which are easily tearable to permit ready displacement of the cover component.

U.S. Pat. No. 5,699,828, also referred to above, addresses the need for measurement of the insulating pieces for proper fit, preliminary to cutting and trimming. The unitary body disclosed is formed with internal measurement indicia, extending longitudinally thereof, comprising a series of hash marks, spaced about ¼ inch apart, and associated consecutive numerical markings.

SUMMARY OF THE INVENTION

Despite the considerable activity and advances in the art indicated above, a need remains for a pipe-covering member which is both highly attractive, from an aesthetic standpoint, and also quick and convenient to install.

It has now been found the foregoing and related objects of the invention are attained by the provision of a covering member comprising a longitudinally slit tubular piece fabricated from a resiliently yieldable material having thermal insulating properties and being capable of manual tearing in relatively thin sections. The tubular piece has a multiplicity of peripherally extending discrete zones of relatively thin section, formed into the inside surface thereof, and adjacent zones of relatively thick section, to provide a series of zones of weakness at regularly spaced intervals along at least a portion of its length; the exterior of the piece is substantially devoid of indication of the presence of the zones of weakness therewithin.

In preferred embodiments, numerical indicia provide a distance scale associated directly with the zones of weakness. The zones of weakness will usually extend continuously and uniformly about the inside surface of the tubular piece, and most desirably they will take the form of substantially V-shaped grooves that are generally tapered from the inside surface toward the exterior. The insulating member will usually be made from a synthetic resinous material, which preferably has a Shore A Durometer value in the range of about 40 to 80, and most desirably 55 to 65, in which case the relatively thin sections comprising the zones of weakness will generally be about 0.020 to 0.080 inch, and preferably about 0.030 to 0.070 inch, in thickness.

In most instances the tubular piece will comprise a curvilinear section and a rectilinear section extending from the curvilinear section, with the portion of the length thereof having the zones of weakness extending from adjacent a free end of the rectilinear section toward the curvilinear section. More specifically, the insulating member will usually be either a unitary cover for application over both the J-bend and the tail piece subassembly, or a waste arm cover.

DETAILED DESCRIPTION OF THE ILLUSTRATED EMBODIMENT

Figure 1:
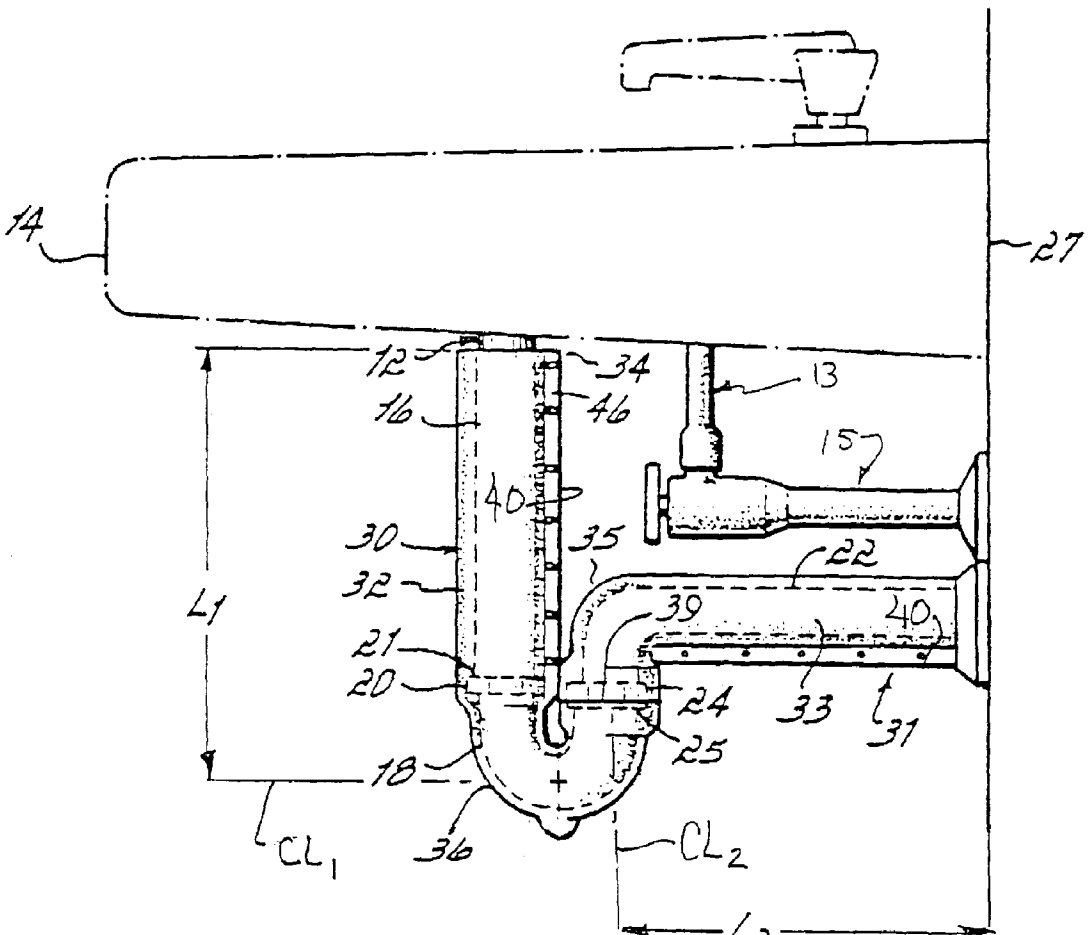
FIG. 1 is a side elevational view of a sink installation in which the underlying plumbing is protected by an insulating covering system embodying the present invention.

Turning now in detail to FIG. 1 of the drawings, therein illustrated is an insulative covering system embodying the present invention installed on P-trap drain piping, generally designated by the numeral 12, beneath a sink 14 (shown in phantom line). The covering system insulates the piping assembly 12 and thereby serves to prevent scalding, burns, abrasions and other injuries that might be caused as a result of direct contact with the piping.

The P-trap assembly 12 is comprised of three pipes, shown by dashed lines; i.e., a straight pipe or "tail piece" 16 that extends downwardly from the sink drain (not shown); a J-shaped pipe or "J-bend" 18 secured to the tail piece by a pipe nut 20 at the juncture 21; and an L-shaped pipe or "waste arm" 22 attached to the other side of the J-bend 18, secured by pipe nut 24 at the juncture 25 and extending through the room wall 27 to the building waste-water disposal system.

The insulating cover system includes a first tubular piece, generally designated by the numeral 30, having rectilinear and curvilinear sections and installed over both the tail piece 16 and the J-bend 18 of the drain piping assembly 12. A portion 34 at the upper end of the rectilinear section 32 of the piece 30 is abutted substantially against the bottom of the drain of sink 14 (for illustrative purposes, however, the end portion 34 is shown to be short of the sink drain); the opposite end terminates in an approximately 180° bend section 36.

A second piece, generally designated by the numeral 31, covers the waste arm 22 and comprises a rectilinear section 33 terminating in an approximately 90° bend section 35. The bend section 35 couples with the end 39 of the 180° bend section 36 of the piece 30 to cover juncture 25, thus providing complete insulation of the pipe assembly 12.

As is conventional, the tubular pieces 30, 31 are fabricated from a relatively soft (typically having a Shore A Durometer value of 55 to 65) synthetic resinous material (e.g. a vinyl thermoplastic, such as PVC, or a solid or foamed polyurethane). As is also conventional, one side of each piece is formed with a longitudinal slit, at 40,extending along its entire length, to allow spreading of marginal portions for facile placement over the corresponding pipe or pipes.

It is noted that the system depicted in FIG. 1 also includes insulating pieces, generally designated by the numerals 13 and 15, covering the hot-water feed tube and the associated value assembly, respectively. Although these components are not described further it will be appreciated that the inventive features disclosed herein may also be applicable thereto.

Figures 2, 3:
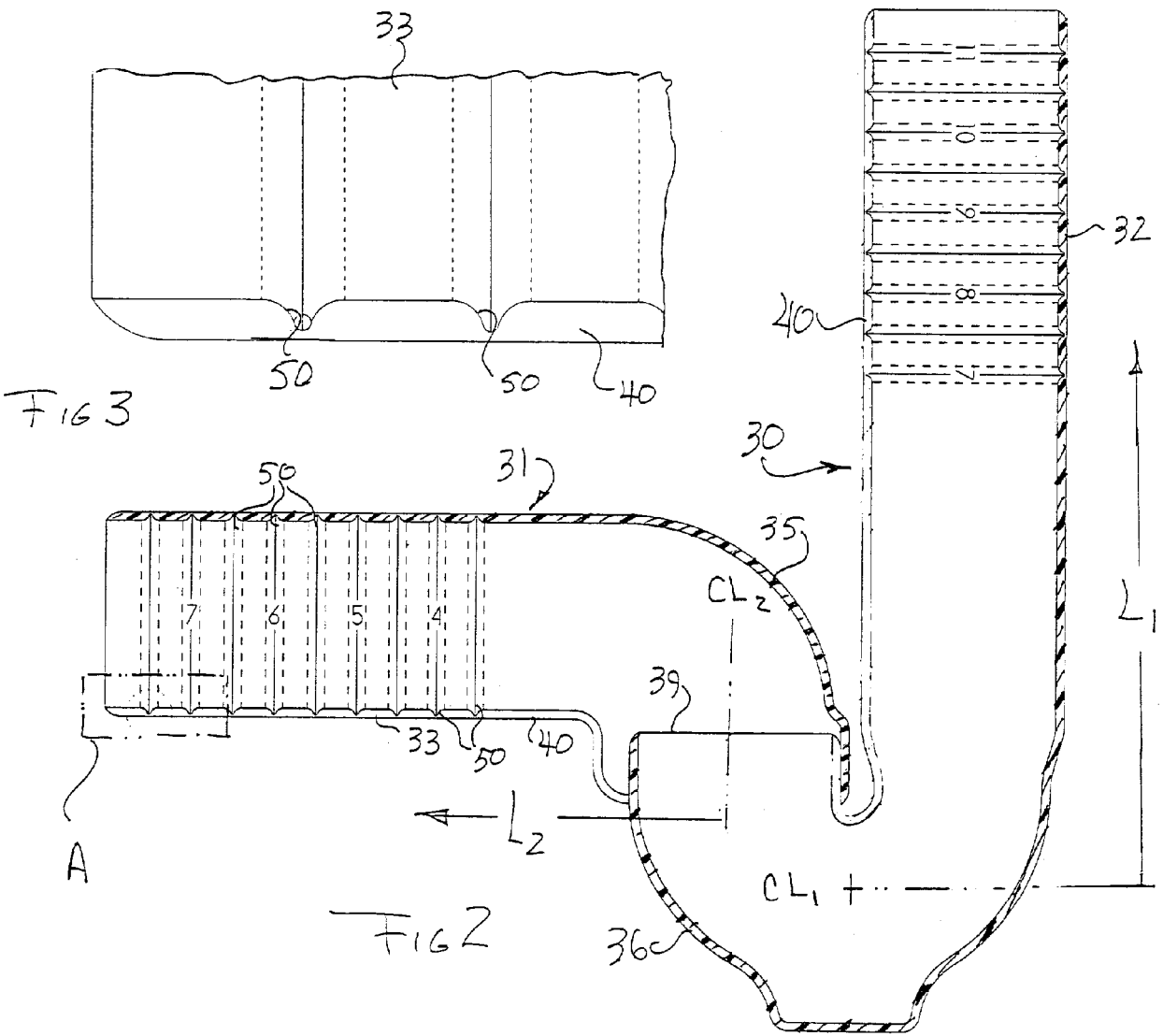
FIG. 2 is a cross-sectional view of the P-trap covering pieces of the system of FIG. 1, incorporating minor modifications and drawn to an enlarged scale.
FIG. 3 is a further enlarged view of a portion, designated "A" in FIG. 2, of the waste arm cover comprising the system.

FIGS. 2 and 3 illustrate the improvements that constitute the present invention, comprising a series of circumferential weakening grooves 50, and a distance scale of associated numeric indicia, formed into the inside surfaces of the covering members. Nine such weakening grooves 50 are provided on the cover piece 30, at ½ inch intervals along the upper, straight section 32, with alternating grooves 50 having associated, consecutive numbers "7" through "11" (indicating of course a one-inch separation between the numbered grooves). The numbers represent the distance $L_1$ (in inches) between a particular weakening groove 50 and the centerline, $CL_1$, of the toroidal portion of the cover piece section 36, and enable ready correlation directly to the length of the J-bend/tail piece pipe subassembly, as measured by the plumber or other installer and as is also indicated by the $L_1$ designation in FIG. 1 (i.e., extending between the top of the tail piece and the centerline of the toroidal section of the J-bend).

The cover piece 31 is similarly provided with ten circumferential weakening grooves 50, with associated consecutive numbers "4" through "7" indicating the distance $L_2$ (in inches) between a particular groove 50 and the centerline, $CL_2$, of the opening into the 90° section 35. These indicia thus correspond to the distance between the centerline of the shorter leg of the waste arm and the adjacent building wall 27, as indicated by the designation $L_2$ in FIG. 1.

It is important to note that the outer surfaces of the pieces 30, 31 are smooth, unbroken and graceful, and show no indication of the presence of the internal weakening grooves 50 therewith, as is highly desirable for affording aesthetic appeal to an insulating system utilizing the covering members of the invention. This can be contrasted with the covers of the prior art (e.g., U.S. Pat. Nos. 5,054,513 and 5,701,929, discussed above), in which grooves and weakened areas are formed into their exterior surfaces.

As a specific example of covering members embodying the invention, fabricated from a PVC vinyl plastic having a Shore A Durometer value of 55 to 65 and having a full wall thickness of about 0.115 inch, the grooves constituting the zones of weakness are tapered to a bottom radius of 0.023 inch, to leave a web thickness of about 0.03 inch. Suitable dimensions will, in any given case, depend upon a number of factors, including primarily the form of the zones of weakness, the nature of the material used for fabrication, the full wall thickness of the part (which may be as thin as about 0.07 inch or as thick as 0.25 inch or more, relatively thick walls being most common when the piece is made, for example, from foamed polyurethane), and manufacturing feasibility and tolerances. Albeit, as depicted in FIGS. 2 and 3, each groove 50 is formed with radii at the entrance and at the bottom, these features result from the use of a mold that is so constructed for the primary purpose of facilitating flow of the molten material therewithin, so as to thereby avoid imperfections and scorching in the finished piece; it is believed however that the ideal groove cross section would have a sharp angle at the bottom, and possibly angular edges at the entrance as well. In any event, the zones of weakness must enable facile manual separation (i.e., tearing away) of excessive-length portions without undue force while, at the same time, being sufficiently strong to avoid damage through normal manipulation and handling during installation (e.g., separation of the marginal portions, which are typically fastened to one another upon delivery to the installer), and to resist inadvertent tearing or tear initiation or propagation at the wrong location.

It will be appreciated that the concepts of the invention are applicable to a variety of insulating pieces suitable for installation on undersink piping, and that the covering systems, and their components, may take a wide variety of forms. Normally, however, a P-trap covering system will comprise two or three pieces, as described in the patents identified above. The covering members may be secured with fasteners of any suitable kind, and they may or may not have marginal flanges for the receipt thereof. Although the covering members will normally be of circular cross section, with circumferential zones of weakening, that is not necessarily the case; reference is therefore made to peripheral, as well as circumferential, zones of weakening. The nature of a distance scale provided may of course vary, and may for example be in either English or metric units. And finally, while the zones of weakening are preferably provided by continuous grooves of uniform cross section, the weakening structure may suitably be discontinuous and/or non-uniform.

Having thus described the invention, what is claimed is:

1. A member for insulating undersink piping, comprising a longitudinally slit tubular piece fabricated from a resiliently yieldable material having thermal insulating properties and being capable of manual tearing in relatively thin sections, said tubular piece having a multiplicity of peripherally extending discrete zones of a said relatively thin section formed into the inside surface thereof, with adjacent zones of relatively thick section, to provide a series of zones of weakness at regularly spaced intervals along at least a portion of the length of said piece, and said tubular piece having, on said inside surface, numerical indicia providing a distance scale associated directly with said zones of weakness, the exterior of said piece being substantially devoid of indication of the presence of said zones of weakness therewithin.

2. The member of claim 1 wherein said zones of weakness extend continuously and uniformly about said inside surface of said tubular piece.

3. The member of claim 2 wherein said zones of weakness are provided by grooves that are generally tapered from said inside surface toward said exterior.

4. The member of claim 3 wherein each of said grooves is of substantially V-shaped cross section.

5. The member of claim 1 wherein said material is a synthetic resinous material having a Shore A Durometer value in the range of about 40 to 80, and wherein said relatively thin section is about 0.020 to 0.080 inch in thickness.

6. The member of claim 5 wherein said Durometer value is in the range of about 55 to 65, and said relatively thin section is about 0.030 to 0.060 inch in thickness.

7. The member of claim 1 wherein said tubular piece comprises a curvilinear section and a rectilinear section extending therefrom, and wherein said portion of the length of said piece having said series of zones of weakness extends from adjacent a free end of said rectilinear section toward said curvilinear section.

8. The member of claim 7 wherein said member is selected from the group consisting of a unitary J-bend and tail piece cover, and a waste arm cover.

9. A member for insulating undersink piping, comprising a longitudinally slit tubular piece fabricated from a resiliently yieldable material having thermal insulating properties and being capable of manual tearing in relatively thin sections, said tubular piece having a multiplicity of peripherally extending discrete zones of a said relatively thin section formed into the inside surface thereof, with adjacent zones of relatively thick section, to provide a series of zones of weakness at regularly spaced intervals along at least a portion of the length of said piece, the exterior of said piece being substantially devoid of indication of the presence of said zones of weakness therewithin.

10. The member of claim 9 wherein said zones of weakness extend continuously and uniformly about said inside surface of said tubular piece.

11. The member of claim 10 wherein said zones of weakness are provided by grooves that are generally tapered from said inside surface toward said exterior.

12. The member of claim 11 wherein each of said grooves is of substantially V-shaped cross section.

13. The member of claim 9 wherein said material is a synthetic resinous material having a Shore A Durometer value in the range of about 40 to 80, and wherein said relatively thin section is about 0.020 to 0.080 inch in thickness.

14. The member of claim 13 wherein said Durometer value is in the range of about 55 to 65, and said relatively thin section is about 0.030 to 0.060 inch in thickness.

15. The member of claim 9 wherein said tubular piece comprises a curvilinear section and a rectilinear section extending therefrom, and wherein said portion of the length of said piece having said series of zones of weakness extends from adjacent a free end of said rectilinear section toward said curvilinear section.

16. The member of claim 15 wherein said member is selected from the group consisting of a unitary J-bend and tail piece cover, and a waste arm cover.

* * * * *